US008215866B2

(12) United States Patent
Whitford

(10) Patent No.: US 8,215,866 B2
(45) Date of Patent: Jul. 10, 2012

(54) PORTABLE PERIMETER DEFENSE BARRIER AND SYSTEM

(76) Inventor: Peter D. Whitford, Pasadena, CA (US)

( * ) Notice: Subject to any disclaimer, the term of this patent is extended or adjusted under 35 U.S.C. 154(b) by 105 days.

(21) Appl. No.: 12/841,137

(22) Filed: Jul. 21, 2010

(65) Prior Publication Data

US 2010/0290833 A1 Nov. 18, 2010

Related U.S. Application Data

(63) Continuation-in-part of application No. 12/115,733, filed on May 6, 2008, now Pat. No. 7,918,622.

(60) Provisional application No. 60/928,332, filed on May 8, 2007.

(51) Int. Cl.
*E01F 13/04* (2006.01)

(52) U.S. Cl. ..... 404/6; 404/9; 256/13.1; 256/24

(58) Field of Classification Search ..... 404/6, 9; 256/13.1, 24
See application file for complete search history.

(56) References Cited

U.S. PATENT DOCUMENTS 5,356,119 A * 10/1994 Schock ..... 256/26
5,549,410 A * 8/1996 Beryozkin et al. ..... 404/6
6,702,512 B1 * 3/2004 Reale ..... 404/6
7,172,176 B1 * 2/2007 Eastland ..... 256/26
7,494,112 B2 * 2/2009 Fromm ..... 256/64
7,819,604 B2 * 10/2010 Breed ..... 404/6
2006/0078380 A1 * 4/2006 Dehart ..... 404/6

* cited by examiner

*Primary Examiner* — Raymond W Addie
(74) *Attorney, Agent, or Firm* — FSB FisherBroyles, LLP; Rachel Healey Huffstetler

(57) ABSTRACT

A portable perimeter defense system is provided that is configured for preventing unwanted intrusions by vehicles or other heavy and fast-moving vehicles into a protected area while also providing requisite ballistic resistance capabilities. The defense system includes at least one individual modular barrier that can be readily transported to a point of use and can be secured in place without requiring heavy equipment or power sources, such as electricity. The modular barrier includes a front plate configured to provide ballistic protection in the direction of impact and to provide an impact surface capable of withstanding impact. The front plate extends upwardly from a base plate and a kick plate extends outwardly from the rear or aft side of the front plate. The front or fore edge of the base plate defines a vehicle engaging interface, the rear or aft edge of the base plate is arcuate and defines a ground engaging interface, and the rear or aft edge of the kick plate defines a ground engaging interface. A ramp is positioned on the base plate in front of the front plate facing the impact direction. When circumstances warrant additional protection and/or a greater span of protection, a plurality of modular barriers may be provided in predetermined configurations. Adjacent barriers may be secured to one another along side edges thereof. The portable perimeter defense system including modular barriers provides exceptional protection to a protected area and may be rapidly deployed.

55 Claims, 10 Drawing Sheets

PORTABLE PERIMETER DEFENSE BARRIER AND SYSTEM

CROSS REFERENCE TO RELATED APPLICATIONS

This application claims the benefit and priority of U.S. Provisional Patent Application bearing Appl. No. 60/928,332, filed May 8, 2007, and is a Continuation-In-Part (CIP) application of U.S. patent application Ser. No. 12/115,733, filed May 6, 2008. The collective disclosures of these applications are hereby incorporated by reference.

BACKGROUND OF THE INVENTION

The present invention relates to a portable perimeter defense barrier and a portable perimeter defense system that can be rapidly and effectively positioned, even on hard surfaces such as asphalt. The present invention also relates to a method of installing a portable perimeter defense system and a method of protecting an area for preventing unwanted intrusions by vehicles or other heavy and fast-moving objects into a protected area, and for providing munitions providing munitions protection at least to .308 caliber BMG M2 ball rounds (or greater) without penetrating the barrier.

Perimeter defense security systems that can stop unwanted intrusions by heavy, fast-moving objects into a protected space are, unfortunately, needed. For example, a heavy tonnage truck filled with explosives or assailants is an inexpensive but effective method used today by terrorists and insurgents to breach and attack a protected space, such as a military installation, embassy compound, or even domestic oil refineries. Moreover, it is also desirable that a perimeter defense system provide munitions protection for personnel, equipment, and/or facilities within the protected space, both as an everyday safeguard against stray munitions and when the barrier system is used in a tactical combat position. Conventional security systems employing conventional barriers are lacking in that they do not provide sufficient breach protection against a heavy and/or fast-moving vehicle nor do they provide sufficient protection from munitions, the impact from shrapnel or shells. In addition, prior art portable perimeter defense systems are not easily or rapidly deployable, are cumbersome to move around, and are difficult to install. Moreover, conventional security barriers do not provide alternative uses for changing conditions and/or security needs and to provide strategic deterrents by altering locations and configurations of a perimeter defense system.

For example, U.S. Pat. No. 7,494,112 (hereinafter the '112 patent) discloses a markedly different barrier system. For example, the barrier system disclosed in the '112 patent requires at least four people to install each barrier. Four people are required because the heavy, individual barriers according to the '112 patent must be manually lifted to be positioned. The amount of physical exertion required to install the barrier system according to the '112 patent is excessive and time consuming, which is disadvantageous in volatile environments wherein circumstances necessitate expedited installation of a defense system or wherein changing conditions warrant movement or other reconfiguration of a defense system. The '112 patent does not provide a defense system for cooperating with hard surfaces, such as asphalt and, due to its configuration, it is not modular and not capable of numerous configurations for changing threatening conditions and/or for alterations as part of a strategic deterrent system. Moreover, the barriers according to the '112 patent do not provide the level of protection from munitions afforded by the portable perimeter defense barrier and system according to the present invention.

Applicant's prior application, U.S. patent application Ser. No. 12/115,733 obviates the shortcomings of prior art barrier systems by providing a portable perimeter defense system consisting of barriers of selected materials and unique configurations to provide munitions protection while simultaneously providing a modular barrier which can withstand extreme impact forces, even on hard surfaces. These extreme impact forces can be absorbed by the barriers of the perimeter defense system according to Applicant's prior application due, at least in part, to the configuration of the barriers and their ability, in certain environments, to be anchored into any surface, either relatively soft (such as, earth) or hard (such as, concrete). The present invention provides the additional advantages of a portable perimeter defense barrier and system which may be readily deployed, positioned and installed an any surface, including hard surfaces, or when circumstances otherwise warrant a barrier positioned on a surface either without an anchoring system or with differing surface engaging attributes. Of course, the barrier of Applicant's Ser. No. 12/115,733 may be employed without an anchoring system, but the present invention affords varying protection for varying circumstances.

BRIEF SUMMARY OF THE INVENTION

The present invention provides a portable perimeter defense bather and system and methods of installing a portable perimeter defense system and for protecting an area that overcomes the shortcomings encountered with prior art systems of this type. The defense system prevents intrusion into the protected space, even from forces by fast-moving, heavy tonnage vehicles which, for example, could contain explosives or assailants. The defense system also provides munitions protection, i.e., ballistic resistance, to personnel, equipment, and/or other facilities within the protected space. The defense system includes at least one modular barrier that provides munitions protection resulting from the unique material and configuration of the face plate, so that the barrier can simultaneously be used to protect persons against such munitions.

The defense system of the present invention is modular so that it can be readily transported to a point of use and can be moved into position and easily removed from position without requiring heavy equipment such as a lifter or a crane, for example. This is achieved without the need of external power sources, i.e., electricity, rendering it desirable in any environment, especially remote military or other tactical installations. The individual components of the various defense systems can be even positioned and installed by very few people, even just one person acting alone. Moreover, the portable perimeter defense system is rapidly deployable because individual modular barriers do not require anchoring to the ground surface. Accordingly, the modular barriers need only to be positioned to provide the aforementioned protection to a protected area. As a result, it is deployable almost anywhere on short notice and is ideal for use in emergency situations. Because the defense system is modular, it can be deployed in different positions or configurations imperative for changing environments and as a strategic deterrent.

The portable perimeter defense system as described herein includes three embodiments. A first embodiment is directed to a portable perimeter defense system comprising a single modular barrier. A second embodiment is directed to a portable perimeter defense system comprising a plurality of modular barriers secured to one another in a side-by-side arrangement to form a customizable width. A third embodiment is directed to a portable perimeter defense system comprising a plurality of modular barriers in a predetermined configuration which are not secured to one another. A portable perimeter defense system according to the present invention may even include a combination of attributes of these embodiments for protecting an area from unwanted intrusions by vehicles or other heavy and fast-moving objects into a protected area, and for providing protection from munitions. The portable perimeter defense systems according to the present invention, and as is described herein, include modular barriers which provide protection against the most stringent while simultaneously providing requisite munitions protection against incoming munitions and the impact of shrapnel and shells. The security capabilities of the three embodiments differ as to the level of protection afforded, the span of the intended protected area, and provide flexibility for varying circumstances and environments.

This is achieved, generally, by providing one or more modular barrier(s) having a ground engaging, substantially flat base plate and a perpendicularly extending front plate fixed thereto. A novel kick plate extends outwardly and generally perpendicularly to the rear side of the front plate, preferably at an acute angle relative to the horizontal. The selected materials and unique configuration of the face plate provide munitions protection while simultaneously providing a modular barrier which can withstand extreme impact forces.

The fore side of the modular barrier, in the impact direction, includes a plurality of fore gusset reinforcements and a ramp for directing an impacting vehicle. The rear or aft side of the modular barrier includes a plurality of aft gusset reinforcements and a wheel assembly for transporting and positioning the modular barrier(s) of the portable perimeter defense system. The aft edge of the base plate includes an arcuate edge for preventing substantial horizontal movement of the barrier under impact forces. The fore edge of the base plate defines a vehicle engaging interface and the aft edge of the base plate defines a surface engaging interface. The aft edge of the kick plate defines a surface engaging interface. Each of these interfaces includes an engaging configuration such as a saw tooth configuration.

Variations of the kick plate are directed to the overall length of the kick plate which may range, preferably, from 4 to 12 inches. Regarding kick plates having a greater length, a kick plate gusset reinforcement is provided for additional structural support. Another variation of the modular barrier provided herein is a novel ground engaging underside of the base plate of the modular barrier to prevent horizontal movement, e.g., sliding or skidding. As will be obvious to one of ordinary skill in the art, each of these bathers according to the various embodiments may be employed in any of the three embodiments of the portable perimeter defense system, alone or in combination with barriers of other embodiments.

The preferred configuration of the modular barrier thereby provides a rigid and sturdy barrier which absorbs the moment generated by the horizontal force from the impact of the vehicle. Barriers of the present invention form a secure defense system even though the system comprises barriers that are modular in construction and can be readily and rapidly moved without any need for excessive lifting by personnel and/or installation equipment and, in fact, be moved by only one person. Upon impact, an intruding vehicle first contacts the ramp of the modular barrier which directs the vehicle, and the impact forces there from, upwardly, toward the front plate. The unique material and configuration of the modular barrier(s) absorbs much of the moment generated by the horizontal force from the impact of the vehicle. Upon impact to the front plate, if the moment is significant so as not be halted, the modular barrier intentionally pivots about ground engaging interface on the aft side of the base plate. As such, the vehicle engaging interface of the fore side of the base plate grips the underside of the intruding vehicle, further halting forward momentum. If the vehicle is not halted, the modular barrier further pivots about the base plate ground engaging interface, thereby resulting in the engagement of the ground engaging interface of the kick plate with the ground. Any remaining forward momentum of the intruding vehicle would be further halted by the kick plate engagement with the ground. The ground engaging interfaces of the base plate and the kick plate are configured so that they actually penetrate and pulverize the ground surface under extreme impact forces and under the weight of the modular barrier.

The method of installing the portable perimeter defense system according to the present invention includes the steps of transporting the defense system comprising of a single barrier or a plurality of barriers to the general vicinity by a trailer; removing the portable defense system from the trailer; relocating the individual modular barrier or barriers to the desired position by forward moving forces, such as by moving the modular barriers or barrier utilizing wheels so as to traverse the ground to the desired location. This is achieved utilizing a hauler assembly or a tow handle assembly, alone or in combination if so preferred. Once positioned, in the embodiments utilizing more than one modular barrier, further barriers may be positioned in the desired configuration and the positioning assembly, the hauler and/or tow handle assembly, is removed. The wheel assembly is positioned into its disengaged position. The method of installing the defense system according to the second embodiment includes the further step of joining adjacent barriers along the sides of the front plate and base plate.

DETAILED DESCRIPTION OF THE INVENTION

Figure 1:
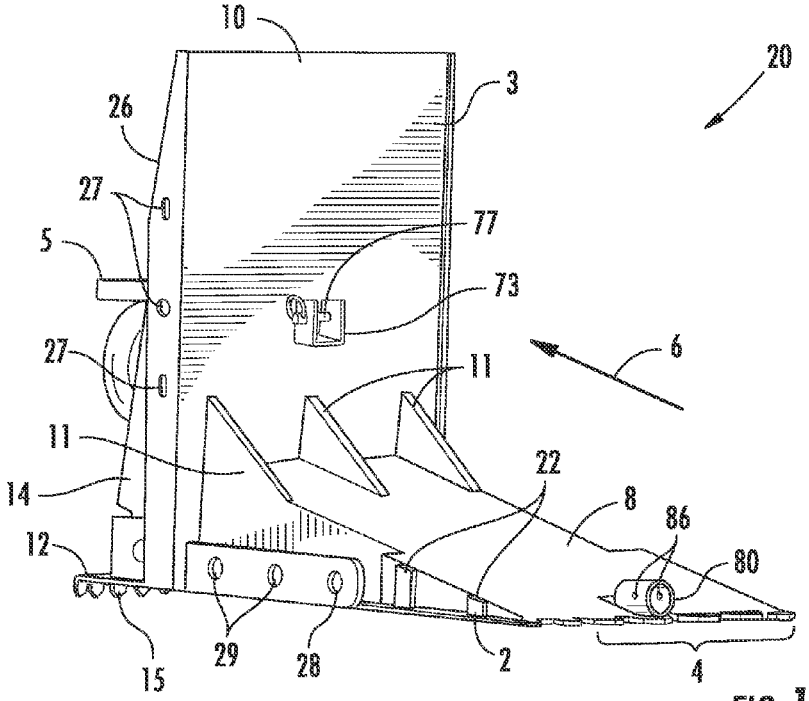
FIG. 1 is a front perspective view (in the impact direction) of the modular barrier according to various embodiments of the portable perimeter defense system according to the present invention.
Figure 2:
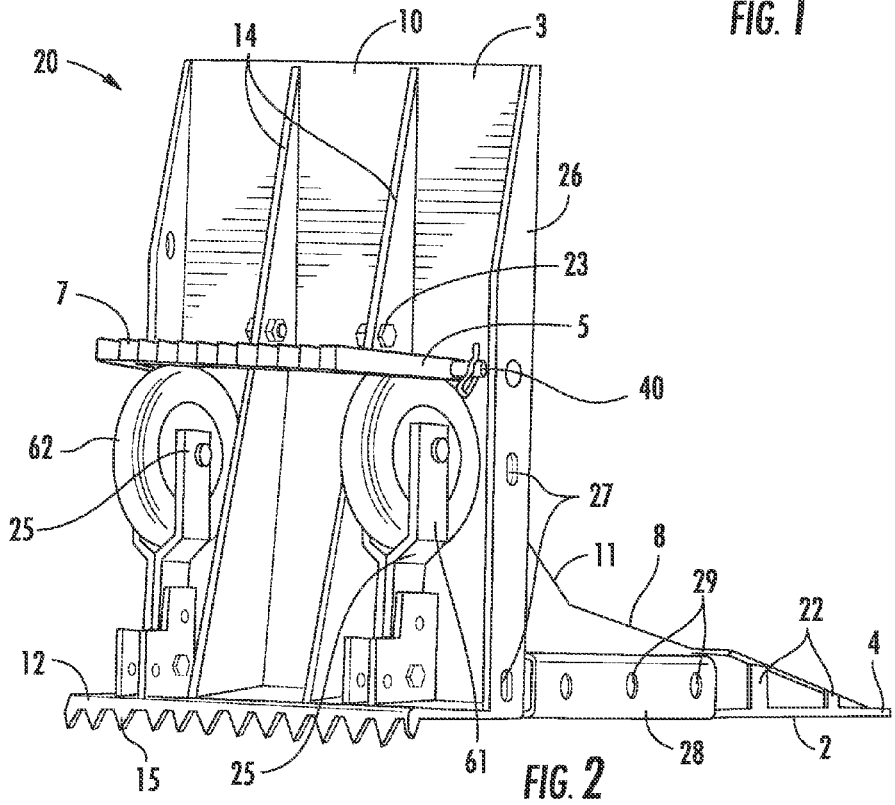
FIG. 2 is a rear perspective view of the modular barrier of the portable perimeter defense system according to various embodiments of the present invention.
Figure 3:
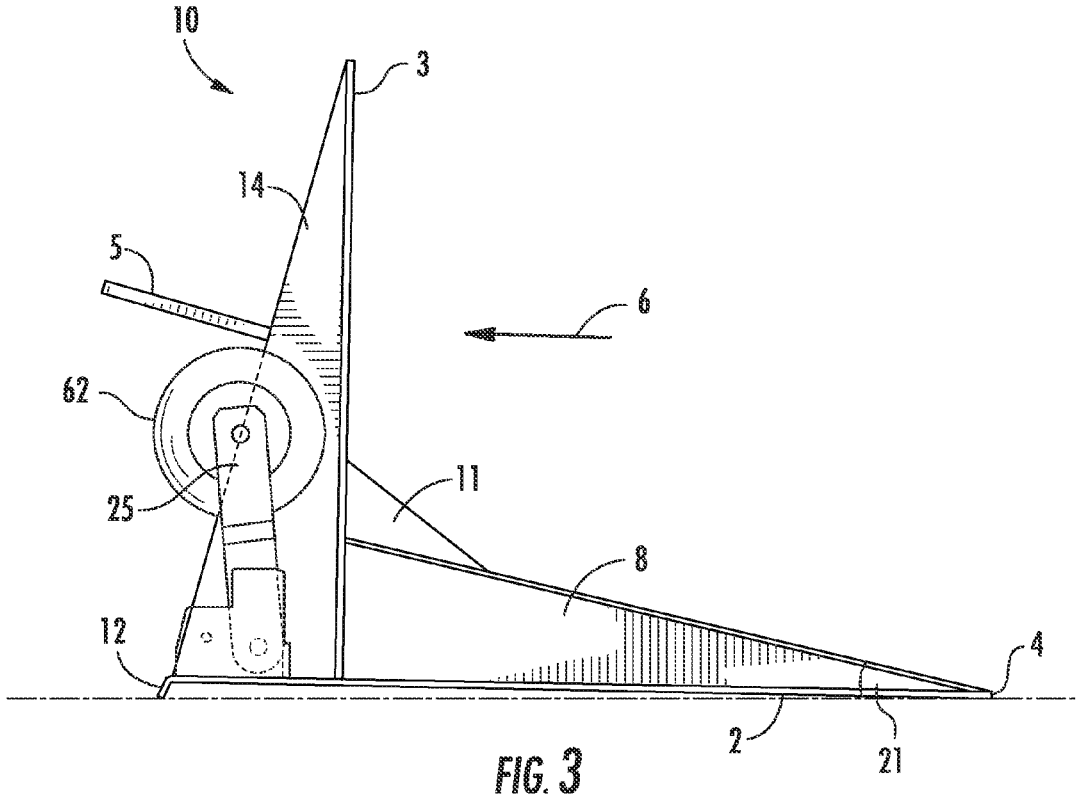
FIG. 3 is a side elevation view, in cross section, of the modular barrier taken along line 3-3 in FIG. 4 according to the present invention.

The present invention will now be described in detail hereinafter by reference to the accompanying drawings. The invention is not intended to be limited to the embodiments described; rather, this detailed description is included to enable any person skilled in the art to make and use the invention. A portable perimeter defense system 20 according to various embodiments of the present invention includes at least one modular bather 10. Referring to FIGS. 1, 2 and 3, modular bather 10 is a generally L-shaped modular bather 10 including a base plate 2 for supporting the modular barrier on a surface and an upwardly extending front plate 3 for receiving impact forces and for providing munitions protection. As seen in FIG. 1, the fore side of base plate 2, as seen in the impact direction 6, includes upwardly extending side plates 28 that include bolt holes 29 to secure adjacent modular barriers 10 as described more fully below. Ramp 8 and a plurality of fore gusset reinforcements 11 are also positioned on the fore, or impact receiving side, of the face plate 3. Base plate 2 also includes a vehicle engaging, fore edge or interface 4. Accordingly, modular barrier 10 is positioned generally transverse, e.g. perpendicular, to a travel direction of a vehicle and its direction of impact 6 against the modular barrier 10.

Referring particularly to FIG. 2, the aft side of modular barrier 10 is shown. Modular barrier 10 includes, generally, kick plate 5, wheel assembly 25, a plurality of aft gusset reinforcements 14, and side plates 26 having bolt holes 27. The base plate 2 on the aft side of the modular barrier 10 also includes a non-linear, angled aft edge 12 described more fully below.

Figure 4:
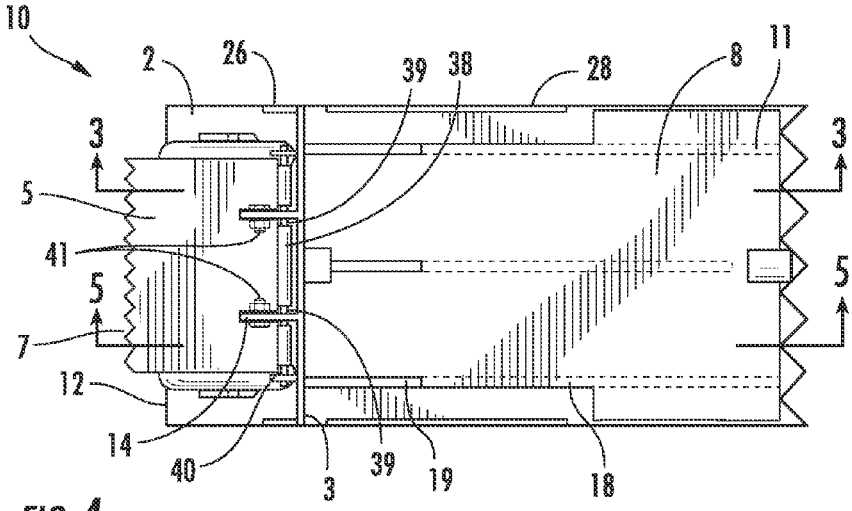
FIG. 4 is a top plan view of the modular barrier according to various embodiments of the portable perimeter defense system of the present invention.

The front surface of front plate 3 preferably offers protection from munitions for persons located behind the barrier 10. As shown in FIGS. 3 and 4, front plate 3 is formed of a single plate panel which may, for example, be formed of an A36 grade steel (the same as, e.g., the base plate, kick plate and ramp) or steel offering greater ballistic capabilities, such as A50 grade, ASTM 572 steel or harder. A front panel formed of A59 grade steel meets or exceeds the following standards: NIJ (National Institute of Justice) Level III-A, Part 1; UL-752 (Underwriters Laboratory) Level 3 Part 3; and ASTM Level .44 Magnums. Alternatively, the front plate could be formed of harder grade steel such as the armor plated steel or have a box-like configuration described in Applicant's prior patent application, which is incorporated herein by reference. Additionally, the front surface of the front plate 3 may be tilted rearward to deflect incoming projectiles upwardly and thereby enhance the ballistic resistance provided by the present invention. This unique combination of materials provides blast mitigation, that is, protection from airborne articles resulting from a nearby blast.

Modular barrier 10 includes base plate 2 that provides a ground platform for the barrier and for supporting front plate 3. A first embodiment of the portable perimeter defense system 20 of the present invention includes a single L-shaped barrier 10. Preferably modular barrier 10 is of limited width, for example between 2 to 3 feet, preferably approximately 2 feet, and limited length, for example, between 3 to 7 feet, preferably approximately 4 feet, to keep it sufficiently light for manual manipulation. The overall length of the modular barrier 10, particularly the length of base plate 2 extending forward (in the impact direction 6) of front plate 3, may be selected to accommodate an appropriate ramp 8 length as described more fully below. The overall height of modular barrier 10 may be any predetermined height, such as between 2 feet and 6 feet, preferably approximately 3 feet. According to second and third embodiments of the portable perimeter defense system 20, several such barriers may be arranged side-by-side to span the width of the roadway or other ground surface across which protection is desired as explained more fully below.

Figure 5:
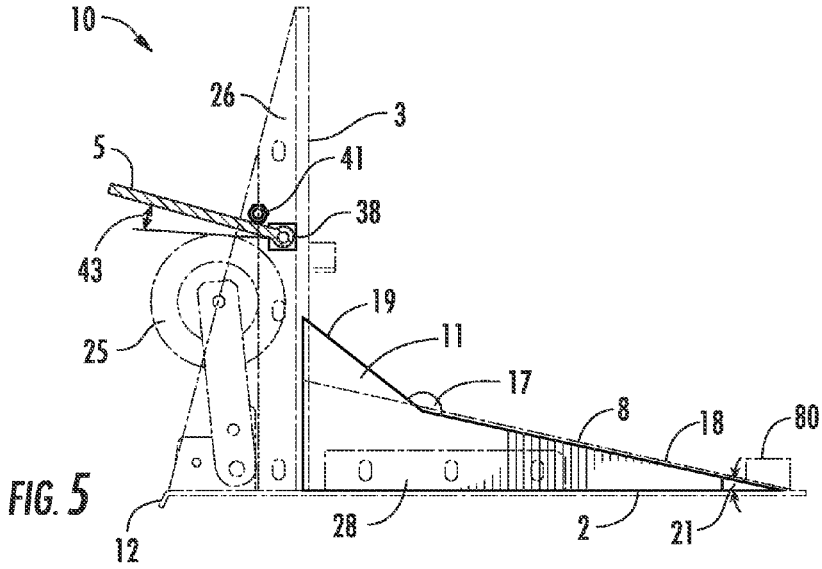
FIG. 5 is a side elevation view taken along line 5-5 in FIG. 4.

Referring to various embodiments of the portable perimeter defense system 20, the modular barrier 10 includes fore and aft gusset reinforcements 11, 14 for supporting front plate 3 and providing additional structural integrity to modular barrier 10 to withstand perpendicular and rotational forces on the barrier caused by the moment when barrier 10 is impacted by a vehicle in impact direction 6. Fore gusset reinforcements 11 support the front surface of front plate 3 that faces impact direction 6, and aft gusset reinforcements 14 support the rear side of front plate 3. FIG. 4 illustrates, in top plan, a preferred fore and aft gusset reinforcement 11, 14 arrangement. As shown, three fore reinforcements 11 are provided wherein the middle reinforcement is shorter than the other reinforcements to accommodate a hauler interface 80 described more fully below. Referring to FIG. 5, taken along line 5-5 in FIG. 4, fore reinforcements 11 are each generally solid. It is within the scope of the present invention, however, to provide non-solid reinforcements. The upper surface of fore reinforcement 11 is angular, having a first surface 18 with a first predetermined slope and a second surface 19 with a second predetermined slope. The first and second surfaces 18, 19 define an obtuse angle 17 there between. The second surface 19 is sloped so as to support a ramp 8 as described more fully below. The second surface is oriented at an angle 21 relative to the base plate 2. Angle 21 may be of any desired acute angle, such as between 5 and 45 degrees, preferable approximately 13 degrees, as shown. Fore reinforcements 11 may be of any desirable thickness, such as between ½ inch and 1½ inches, preferably approximately ¾ inch thick. Fore reinforcements 11 are preferably formed of A36 (or harder) steel and are welded to base plate 2 and front plate 3.

Aft gusset reinforcements 14, shown in FIGS. 2 and 4, support the rear side of front plate 3. Aft reinforcements 14 are positioned so as to be off-centered, or not aligned, with fore reinforcements 11 to further enhance the strength of modular barrier 10 so as to absorb forces and prevent potential movement of modular barrier 10 in a horizontal direction under force from an impacting vehicle. As illustrated, a pair of aft reinforcements 14 extends substantially the height of front plate 3 and extends outwardly from the rear side of front plate a distance substantially extending the length of base plate 2 so as to form a triangular reinforcement in side elevation. Of course, it is within the scope of the present invention that aft reinforcements 14 may be of any predetermined height or length (measured in the horizontal direction). Aft reinforcements are preferably welded to base plate 2 and front plate 3. Aft reinforcements 14 may be of a predetermined thickness, such as between ¼ to 1½ inches, preferable ¾ inch. Aft reinforcements 14 each contain at least one hole 23 for preventing upward rotation of kick plate 5 as described more fully below. A plurality of such holes 23 may be provided to facilitate customizable positioning of kick plate 5. Aft reinforcements 14 are preferably formed of A36 steel or harder.

Ramp 8 is supported by fore reinforcements 11 and extends outwardly and downwardly from the front side of front plate 3 facing impact direction 6. Ramp 8 is seated upon second surface 19 of fore reinforcement 11 and secured, such as be welding, to front plate 3 and base plate 2. Ramp 8 is configured so as to permit first surface 18 of fore reinforcements 11 to extend through ramp 8. Along its sides, ramp 8 may preferably be reinforced by base plate reinforcements 22. As illustrated, base plate reinforcements 22 may be bent tab type reinforcements. The joints are preferably joined, such as by welding. As shown, ramp 8 is a hollow construction, but it is within the scope of the present invention to provide a solid ramp 8 supported on base plate 2. Also as shown, ramp 8 is a continuous sheet of approximately ¼ inch steel, such as A36 steel or harder, configured to receive first surfaces 18 of fore reinforcements 11, but two or more separate members (not shown) may be employed to form ramp 8. These members may be joined together by means known to one of ordinary skill in the art, or they may be positioned separate, forming a non-continuous ramp. As discussed more fully below, an intruding vehicle first encounters ramp 8 from impact direction 6 which directs the impacting vehicle and its imparting forces in the desired direction for contacting front plate 3 of modular bather 10 to thereby impede the oncoming vehicle. In the illustrated embodiment, and incoming vehicle would be directed at an angle 21 of approximately 13 degrees relative to the horizontal.

Rearward movement, e.g. movement traversing the ground surface, of an individual modular barrier 10 is prevented, at least in part, by arcuate aft edge 12 of base plate 2 as shown in FIG. 3. While not intending to be bound by any particular theory, it is believed that the arcuate aft edge 12 provides an abutting surface which, in combination with the barrier's weight, provides sufficient frictional forces to substantially limit or prevent horizontal movement of the modular barrier 10 upon impact. While an arcuate profile of the aft edge 12 is shown, it is contemplated that the aft edge 12 may have other configurations, such as an angular profile (not shown), wherein the aft edge cooperates with the ground surface for preventing horizontal movement of the modular bather upon impact.

Rearward movement of an individual modular barrier 10 is also impeded by the unique configuration of arcuate aft edge 12. Referring to FIG. 2, aft edge 12 includes a saw tooth surface engaging interface 15 extending substantially along the length thereof. As explained more fully below, the surface engaging interface 15 is configured to forcefully engage, and under extreme forces actually burrow into and pulverize surfaces, such as asphalt. Under impact forces of an intruding, high speed vehicle, surface engaging interface 15 may become the fulcrum point of intended modular barrier 10 rotation/pivot, as described below. It is within the scope of the present invention to provide a surface engaging interface 15 of any surface engaging configuration, preferably, as shown, a saw tooth configuration having, for example, approximately ¾ inch deep saw tooth notches that are approximately 1 inch in width each. Other configurations including, but not limited to, a spined edge, a barbed edge, or even a straight edge are within the scope of the present invention. Additionally, surface engaging interface 15 need not extend the entire length of arcuate aft edge 12 and may be a single or a plurality of spaced apart surface engaging protrusions or the like.

Referring to FIGS. 1 and 4, base plate 2 has a front edge, in the impact direction 6, that has a vehicle engaging interface 4 as will be explained more fully below. It is within the scope of the present invention to provide a vehicle engaging interface 4 of any configuration, preferably, as shown, a saw tooth configuration having, for example, approximately 2 inch deep saw tooth notches that are approximately 4 inches in width each. Other configurations including, but not limited to, a spined edge, a barbed edge, or even a straight edge are within the scope of the present invention. Additionally, vehicle engaging interface 4 need not extend the entire length of base plate 2 and may be a single or a plurality of spaced apart vehicle engaging protrusions or the like.

Variations of modular barrier 10 are described in detail herein and any of these variations may be employed in each of the embodiments of the portable perimeter defense system 20. Moreover, a combination of variously described modular barriers 10 may be employed in any one embodiment of the portable perimeter defense system of the present invention.

Kick plate 5 is positioned on the rear side of front plate 3 of the modular barrier 10 as best shown in FIGS. 2, 4 and 5. Referring specifically to FIGS. 4 and 5, kick plate 5 includes a tube-like fore edge 38 for securing kick plate 5 to front plate 3. Kick plate fore edge 38 defines notches, or recesses, 39 for receiving correspondingly configured aft gusset reinforcements 11. Kick plate 5 is vertically positioned along the height of front plate 3 such that the openings of tube-like fore edge 38 correspond with aft gusset reinforcement holes 23. A pin 40, such as a ⅞" diameter steel rod formed from, e.g., A 449 grade steel or harder, may be inserted through tube-like fore edge 38 and reinforcement holes 23 to secure kick plate 5 on front panel 3. Steel pin 40 is preferably longer than the width of kick plate 5, such that keeper pins (shown in FIG. 2) may then be inserted into the ends of the steel pin 40 to secure kick plate 5. Accordingly, the novel configuration of the kick plate notches 39 abutting the sloped surface of aft reinforcements 14, maintains kick plate at the desired vertical height as well as the desired angular orientation relative to the horizontal. Through-bolts 41 are provided and extend through correspondingly positioned holes 46 on kick plate gusset reinforcement 45 and aft reinforcements 14 for preventing upward rotation of the kick plate 5, particularly upon impact as described below. Through bolts 41 may be removed to permit kick plate 5 to be rotated in a vertical position for transportation. A stop may be secured to front plate 3 to position kick plate 5 in a desired angular orientation relative to front plate 3 and for preventing unintentional downward rotation of kick plate 5.

Referring to FIGS. 4 and 5, kick plate 5 is formed of steel, such as A36 grade or harder and extends from the rear side of front plate 3, preferably, at an angle 43 relative to the horizontal. This angle 43 may be predetermined based on circumstances or may be adjusted in the field when modular barrier 10 is positioned. Angle 43 may be between 0 and 60 degrees, preferably between 10 and 30 degrees, such as 15 degrees. Kick plate 5 also includes a surface engaging interface 7 for preventing intrusion of unwanted vehicles as explained more fully below. Surface engaging interface 7 may have any desired configuration and, in the preferred embodiment shown, a saw tooth configuration has, for example, approximately ¾ inch deep saw tooth notches that are approximately 1 inch in width each. Other configurations including, but not limited to, a spined edge, a barbed edge, or even a straight edge are within the scope of the present invention. Additionally, surface engaging interface 7 need not extend the entire width of kick plate 5 and may be a single or a plurality of spaced apart surface engaging protrusions or the like. Moreover, modular barrier 10 includes kick plate 5, as shown in FIGS. 4 and 5, having a first predetermined length, preferably 6" to 1 ft. 6", such as 1 ft. The length of kick plate may be altered for varying circumstances and it is within the scope of the present invention to provide a modular barrier 10 with alternative kick plates 5 for varying uses and circumstances.

Figure 6:
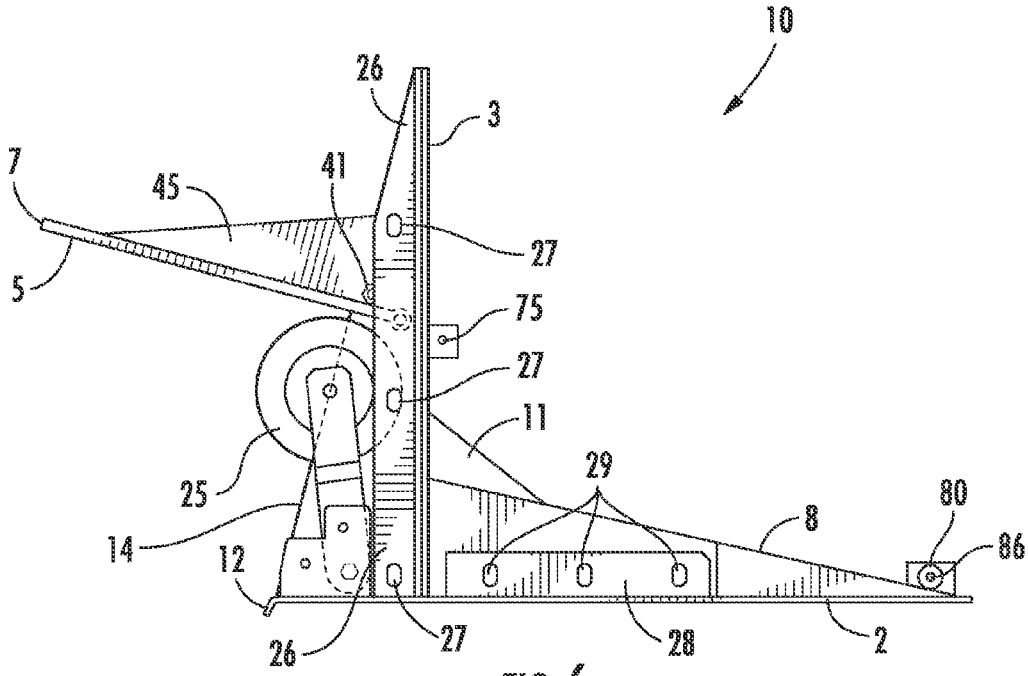
FIG. 6 is a side elevation view of a modified modular barrier in accordance with various embodiments of the present invention.
Figure 7:
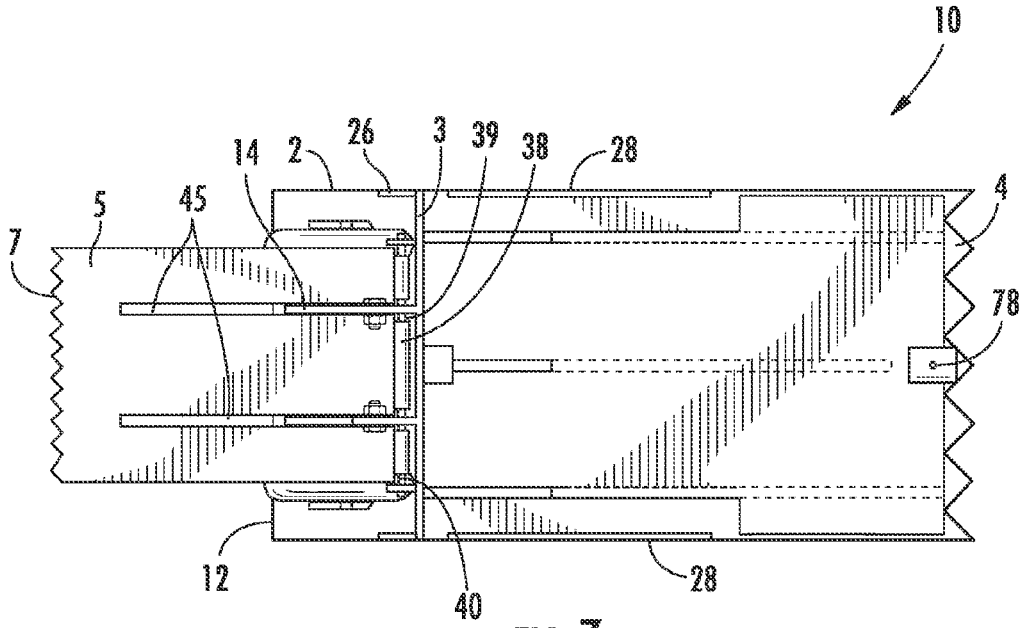
FIG. 7 is a top plan view of the modular barrier of FIG. 6.

Modular barrier 10 according to the present invention having a modified kick plate 5 is shown in FIGS. 6 and 7. According to this modification, kick plate 5 is elongated and, as shown, preferably is approximately 2 feet in length. A pair of kick plate gusset reinforcements 45 extends upwardly from kick plate 5. Kick plate reinforcements 45 each define at least one hole such that bolt 41 extends through kick plate reinforcement hole 46 and aft reinforcement hole 23 as best shown in FIG. 7. It is within the scope of the present invention that kick plate reinforcement is of appropriate width, preferably between ¼ inch to 1½ inches, such as ⅝ inches.

Figure 10A:
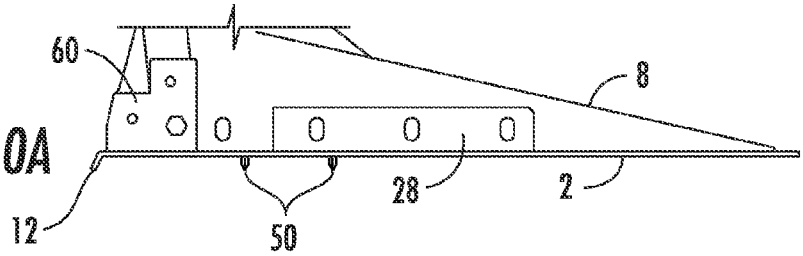
FIG. 10A is a side elevation view of another variation of the modular barrier having a novel base plate.
Figure 10B:
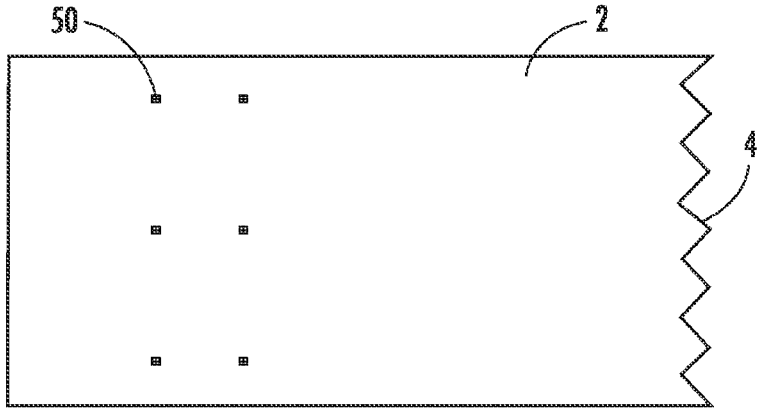
FIG. 10B is a bottom plan view of the modular barrier of FIG. 10A.

Another variation of modular barrier 10 according to the present invention is shown in FIGS. 10A and 10B. The bottom of base plate 2 includes at least one, and preferably a plurality of ground engaging extensions 50 which, as shown, are in the form of spikes. While any number and configuration of spikes 50 may be provided, a preferred number and configuration are illustrated in the drawings. This configuration prevents, or at least minimizes, horizontal movement, such s sliding or skidding, of modular bather 10 along the ground surface both in a front-to-back and side-to-side manner (or combination thereof). Of course it is within the scope of the present invention to use any irregular surface along the bottom of base plate 2 to engage, either frictionally or by penetrating the ground surface, to prevent horizontal movement of modular barrier 10 along the ground surface.

While formidable against intrusion as a single modular barrier, varying circumstances warrant protection from intrusion against a span, such as the length of an entranceway or roadway. Accordingly, two or more modular barriers 10 may be positioned adjacent one another to achieve a portable perimeter defense system having a customizable width. Portable perimeter defense systems 20 according to second and third embodiments of the present invention include more than one modular barrier. According to the second embodiment, the plurality of modular barriers 10 are secured to one another and according to the second embodiment the plurality of modular barriers 10 are not secured to one another.

Figure 8:
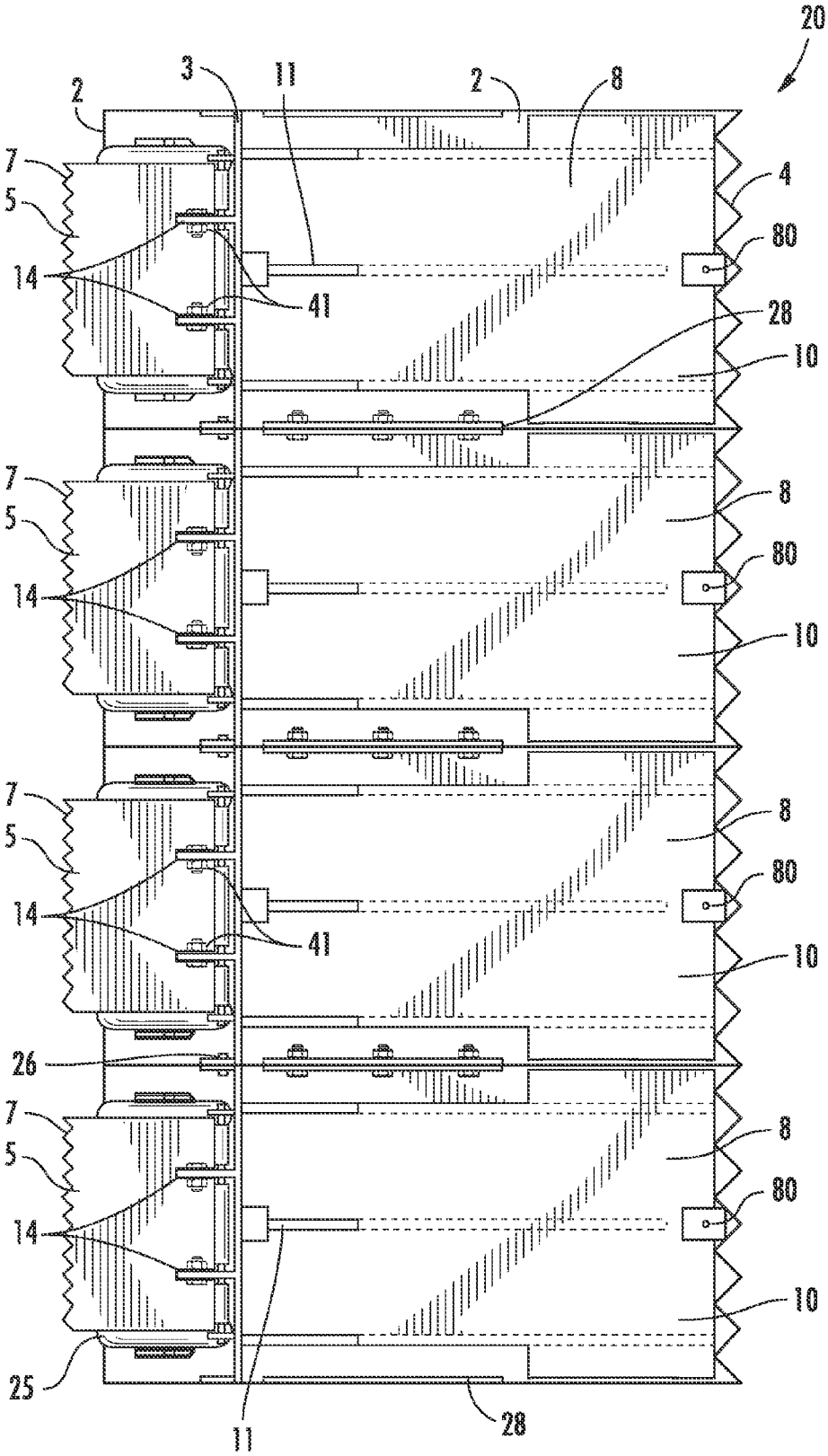
FIG. 8 is a schematically illustrated, top plan view of the second embodiment of the portable perimeter defense system illustrating a number of modular barriers to provide a portable perimeter defense system with a customizable width.

As to securing adjacent modular barriers 10, FIG. 6 is a detailed elevation view of modular barrier 10, and FIG. 8 is a top plan view of the same. As best seen in FIG. 6, side plate 26 is secured, e.g. welded, to a side edge of front plate 3. Side plate 26 includes bolt holes 27 that enable two barriers 10 to be disposed side by side and secured, e.g. bolted, together through holes 27. This arrangement enables barrier 10 to be installed in a modular manner to produce a single continuous barrier of a customizable width. Similarly, side plates 28, having bolt holes 29, may also be secured, e.g. welded, to the lateral edges of the base plate 2. Adjacent modular barriers 10 may be further secured, e.g., bolted, alongside plates 28 to reinforce the side-to-side connection between adjacent barriers 10. Adjacent modular barriers 10 may be secured by means known to on or ordinary skill in the art in addition to the use of bolts, for example, barriers may be joined by a cable. Side plates 28 may alternatively be continuous with base plate 2 and bent upward substantially perpendicular to the base plate.

The portable perimeter defense system 20 comprising one or more modular barriers 10 according to the present invention thereby provides a formidable barrier against unwanted intruding vehicles while simultaneously providing munitions protection to .308 caliber BMG M2 ball rounds without penetrating the barrier. According to the first embodiment of the portable perimeter defense system of the present invention, one modular barrier 10 is provided. An intruding vehicle, traveling in the general impact direction 6, contacts ramp 8 and is directed upward at an angle 21 equal to the slope of second surface 19 of ramp 8 and thereby impacts front plate 3. Upon impact, modular barrier 10 absorbs much (or all) of the moment generated by the generally horizontal force from the impact of the vehicle. If the moment is not fully absorbed by modular barrier 10, the barrier pivots rearwardly, about surface engaging perimeter 15 of aft edge 12 of base plate 2. Surface engaging perimeter 15 thereby engages, in fact penetrates, the ground surface, thereby razing the surface within which it contacts due to the weight of modular barrier 10, the incoming vehicle, and the moment generated by the incoming vehicle.

When modular barrier 10 is pivoted about surface engaging interface 15, vehicle engaging interface 4 is forced upwardly against the underside of the unwanted, intruding vehicle which is now likely at least partially lifted off of the ground. Saw tooth configuration of vehicle engaging interface 19 of front plate 3 thereby engages and, in some instances, pierces the vehicle, such as its underside, further deterring forward momentum of the vehicle. If the moment is not fully halted, modular barrier 10 pivots further about ground engaging interface 15, and kick plate 5 thereby forcefully engages the ground surface. If the intruding vehicle maintains any forward motion at this point, kick plate 5 halts any more substantial forward motion of the vehicle. This is because kick plate ground engaging interface 7, preferably in a saw tooth configuration, engages and likewise penetrates (and pulverizes) the ground surface, stopping any further forward momentum of the vehicle. The angular orientation 43 of kick plate 5 facilitates appropriate contact of ground engaging interface 7 of kick plate 5.

A portable perimeter defense system 20 according to a second embodiment of the present invention comprises a plurality of modular marries, e.g., four modular barriers, as shown in FIG. 8 in top plan, secured to one another in a side-by-side fashion. Although four modular barriers are depicted, it is to be understood that any number of barriers may be employed. Tests have been conducted on a portable perimeter defense system 20 employing four barriers 10 positioned in a side-by-side configuration and secured to one another by bolting side plates 26, 28 between adjacent barriers 10. Tests have shown that an approximately 3500 lb. vehicle (such as a domestic mini-van), traveling at 50 mph and ramming into the portable perimeter defense system 20, had a dynamic penetration of approximately 8 feet. Dynamic penetration as used herein refers to the distance, beyond the original impact point of the vehicle with the barrier, in which the vehicle is completely stopped. This meets, minimally, an ASTM rating of C50P3. This particular test resulted in the portable perimeter defense system 20, upon impact by a minivan, to pivot about base plate ground engaging interface 15 whereby the minivan became airborne. The portable perimeter defense system 20 absorbed forces without substantially pivoting about aft edge 15 of base plate 2. Kick plate ground engaging interface 7 was not needed to further halt forward motion of the intruding vehicle. Of course, had it been necessary, kick plate 5 would have facilitated halting additional intruding vehicle forward motion.

Figure 9:
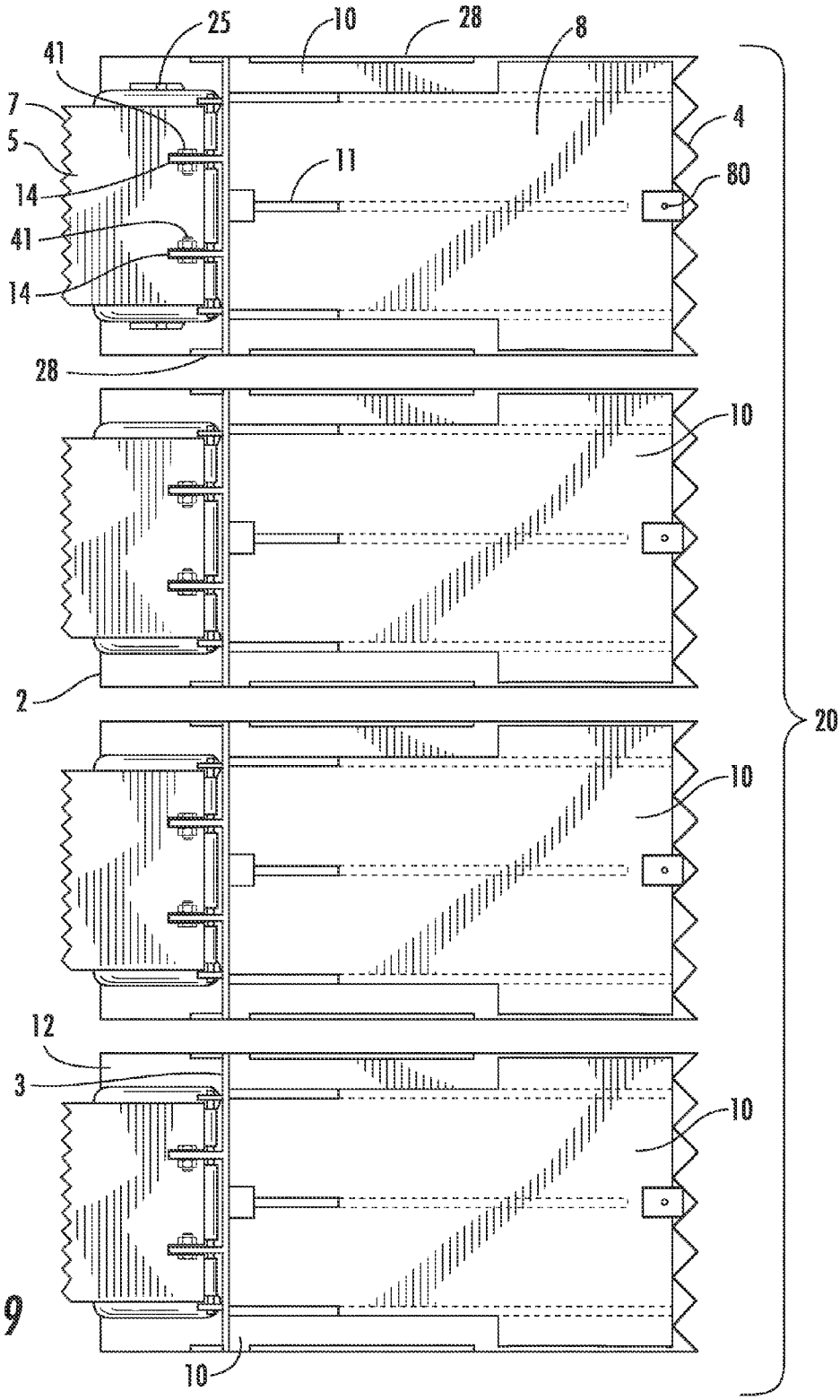
FIG. 9 is a schematically illustrated, top plan view of a third embodiment of the portable perimeter defense system which illustrates a second exemplary configuration of unattached modular barriers.

A third embodiment of the portable perimeter defense system according to the present invention includes more than one modular barrier 10 that are positioned within the vicinity of one another, e.g., in a side-to-side manner, with a distance between adjacent barriers 10. Modular barriers 10, therefore, are unsecured to one another. Although four modular barriers are depicted, it is to be understood that any number of barriers may be employed. It is within the scope of the present invention to also secure barriers positioned with a distance there between with an extendable attachment, such as a cable or the like. An exemplary third embodiment is best illustrated in FIG. 9 (in top plan) wherein adjacent modular barriers are distanced between on another (with no attachment means adjoining adjacent barriers 10). This distance may vary, of course, depending upon the anticipated threat and the span of pathway to be protected. As shown, a portable perimeter defense system 20 according to the third embodiment includes adjacent barriers 10 with approximately 6 inches there between. Tests were conducted on one a portable perimeter defense system 20 comprising four modular barriers 10 configured in a single row with an approximately 6 inch distance between adjacent barriers, as illustrated in FIG. 9. Tests indicated that a small passenger vehicle, traveling at 30 mph was effectively stopped from intruding the protected space. In fact, dynamic penetration of the vehicle was approximately 14 feet. It is also within the scope of the present invention, according to the third embodiment, to provide a plurality of adjacent modular barriers 10 in a single line as shown, in a staggered formation, in a double or more lines, or in any other desired formation enabled by its novel design.

Figure 11:
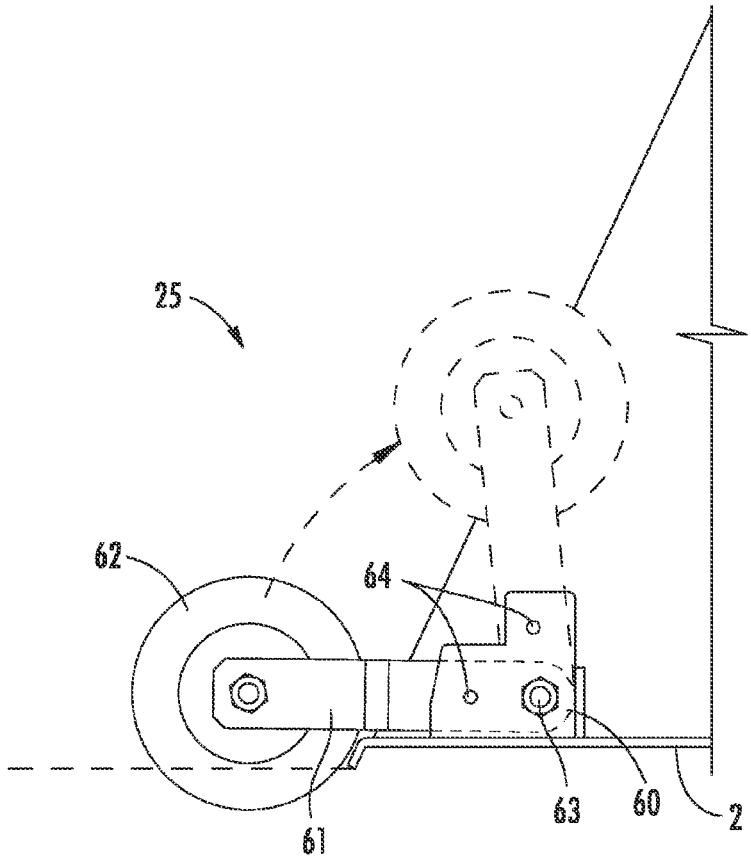
FIG. 11 is a detailed side elevation view of the wheel assembly in accordance with embodiments of the present invention.

FIG. 11 illustrates a retractable wheel assembly 25 of the present invention for readily moving the barrier over road, ground and other surfaces. As best seen in FIG. 11, a wheel assembly 25 is arranged on either side of base plate 2 and provides rolling ability to the modular barrier 10. Each wheel assembly 25 includes a wheel attachment 60 secured to and projecting upwardly from base plate 2. A fork 61 rotatably mounts a preferably puncture-resistant wheel 62. The fork is secured to attachment 60 by a pivot 63. Pin holes 64 are provided on attachment 60 for securing the fork 61 (and wheel 62) in a deployed position and a stored (disengaged) position, respectively, using pin 65. Fork 61 with wheel 62 can be pivoted between an engaged position (for wheeling the barrier to or from an installation site) and a disengaged, retracted position (shown in phantom in FIG. 11) when the barrier is deployed.

Figure 12:
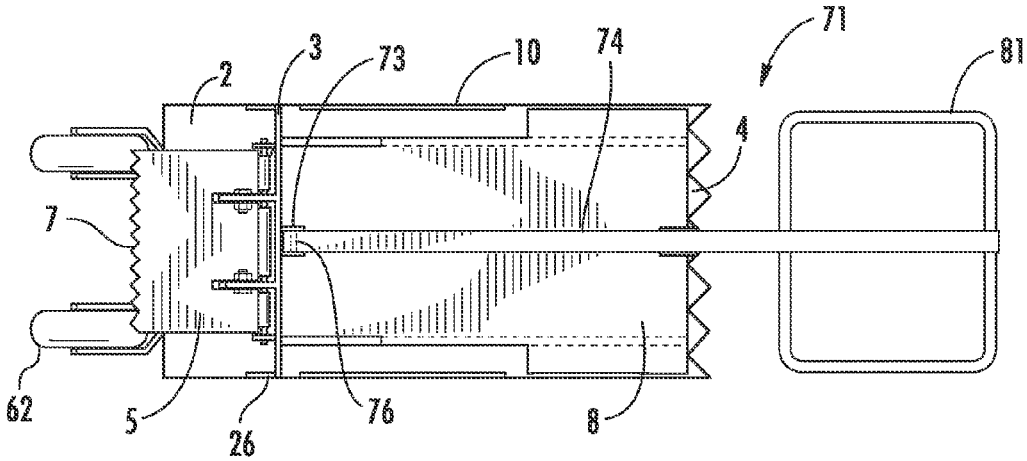
FIG. 12 is a top plan view showing a tow handle assembly of the m modular bather in accordance with embodiments of the present invention.
Figure 13:
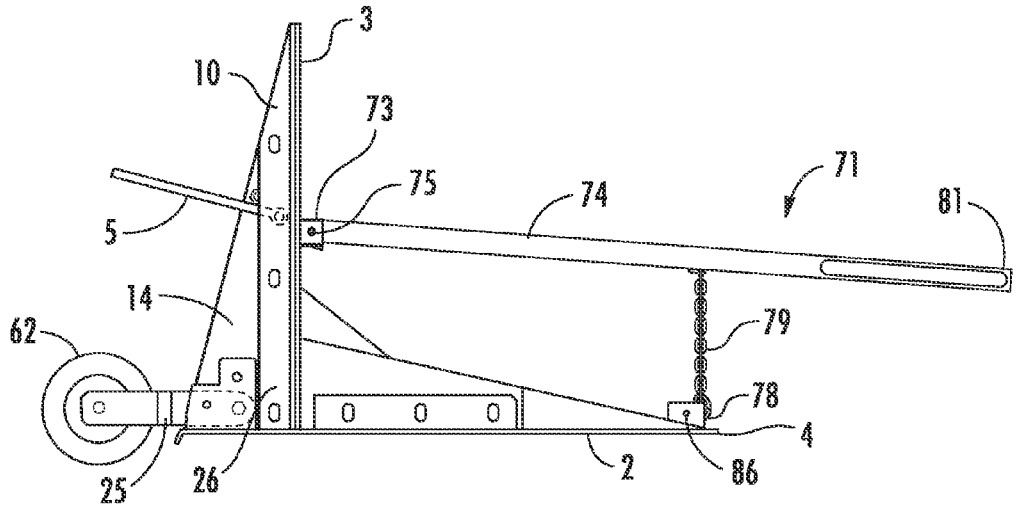
FIG. 13 is a side elevation view of the tow handle assembly shown in FIG. 12.
Figure 14:
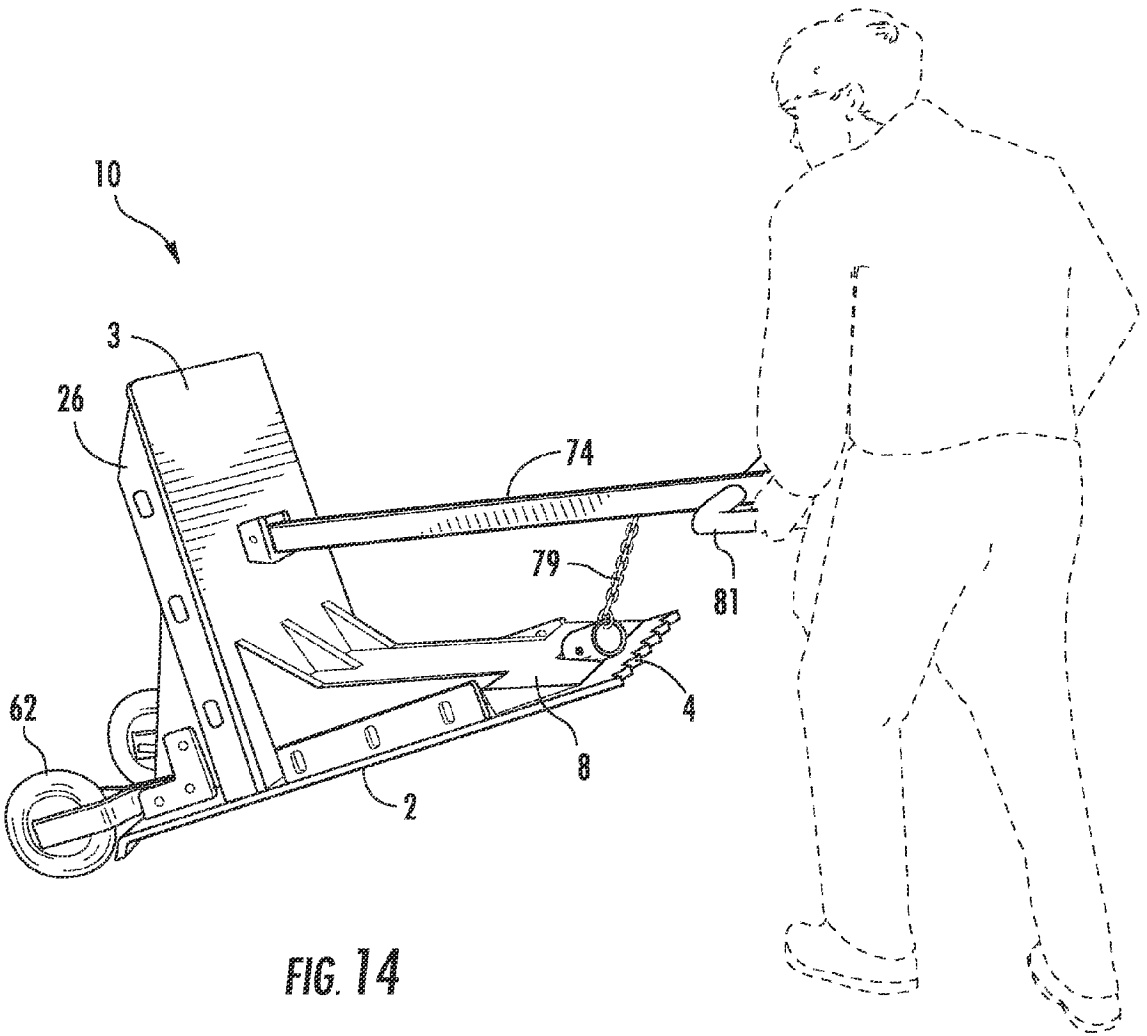
FIG. 14 is a perspective view of the modular barrier being transported with the tow handle assembly.

Wheel assemblies 25 are employed when modular barriers are transported and positioned. FIGS. 12-14 illustrate a preferred embodiment of a transporting assembly according to the present invention. FIG. 13 is a side elevation view and FIG. 12 is a top plan view showing a transporting assembly in the form of a tow handle assembly 71. Tow handle assembly 71 cooperates with tow interface 73 which projects from front plate 3 and which is configured to receive one end of tow bar 74. Tow interface 73 includes a pin hole 75 that corresponds to a pin hole 76 in the received end of the tow bar 74. A pin 77 is placed through holes 75 and 76 to secure the end of the tow bar 74 to front plate 3. A hole 78 located on a hauler interface 80 (described more fully below) extends upwardly from base plate 2 and is engaged by the ends of chain 79. The other end of chain 79 is secured, e.g. hooked, to tow bar 74 at an intermediate point. A handle bar 81 extends from the other end of tow bar 74 so that personnel deploying the barrier 10 can lift the front end of the barrier off the ground to move the barrier 10 on wheels 62 when they are pivoted into their engaged position as shown in FIG. 14. Tow bar assembly 71 can also be coupled to a truck or the like to provide rapid mobility for the barrier 10 by towing it to the desired location.

Figure 15:
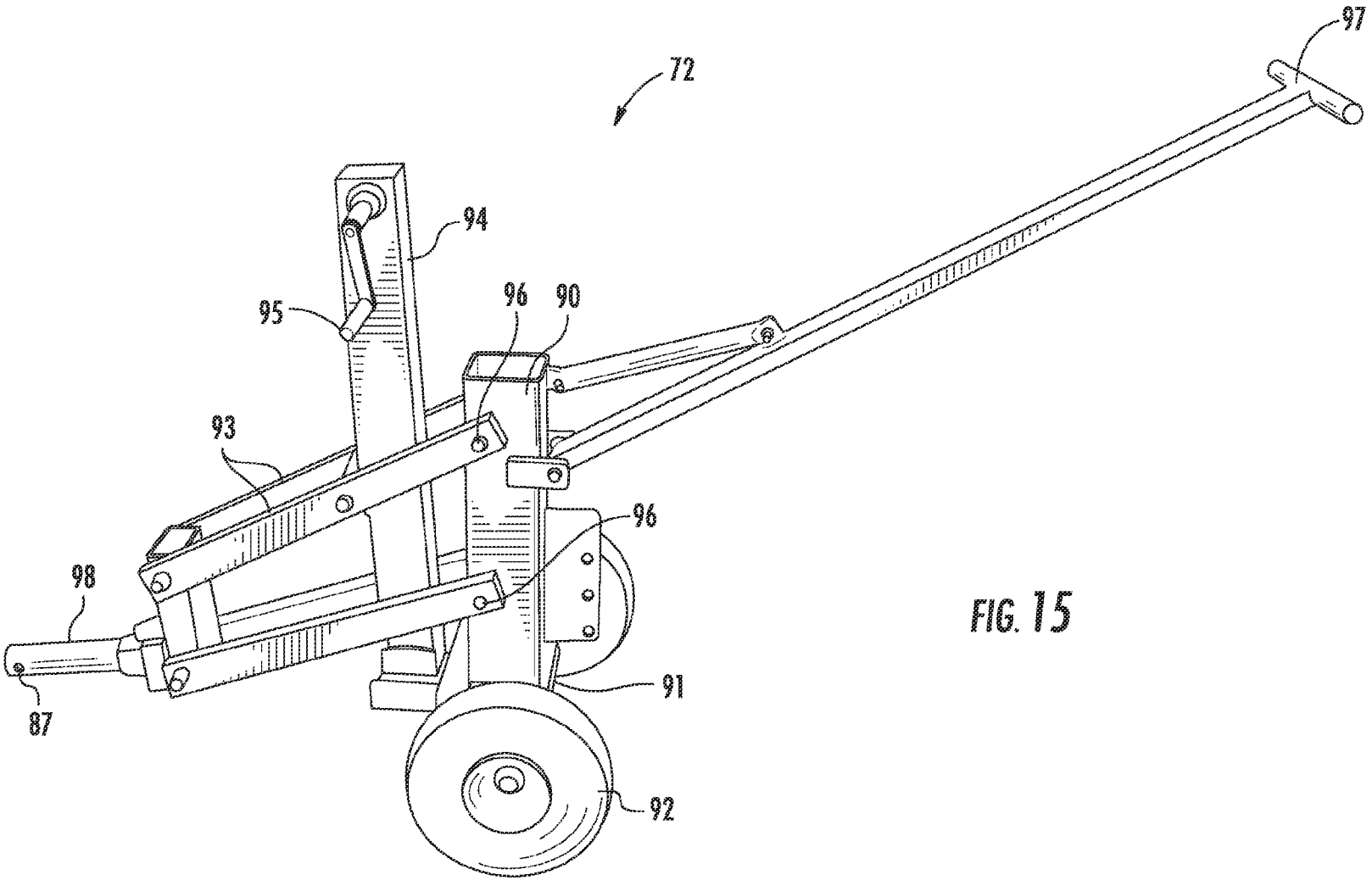
FIG. 15 is a perspective view illustrating another transporting assembly, the hauler assembly, in accordance with embodiments of the present invention.

A transporting assembly 70 in the form of a hauler assembly 72, shown in FIG. 15, may also be used to position individual modular barriers 10. Hauler assembly 72 includes frame 91 supporting a hollow column 90 and wheels 92. The frame 91 further includes generally horizontal frame members 93 extending outwardly from and being pivotally attached to column 90. Vertical member 94 is connected to the frame 91 and houses the raising mechanism to raise a mating element 98 or nose that cooperates with the modular barrier 10 to raise the front end thereof. The nose 98 of the hauler assembly is received within the hauler interface member 80. The mating element 98 includes a pinhole 87 and the hauler interface 80 includes a pinhole 86. When the two are engaged, therefore, a pin is positioned within the corresponding pinholes 86, 87 to further secure the connection of the hauler assembly 72 and the modular barrier 10 for transport. Vertical member 94 includes a hand crank 95. Accordingly, the hand crank 95 is rotated by the user and vertical member 94 serves as a jack to raise the horizontal members 93 which pivot about point 96 to raise the nose and, hence, raise the front edge of the barrier to fully engage the wheels 25 of the modular barrier for transport. The weight of the modular barrier is then supported by the wheels 62 in the engaged position. The vertical member 94 my include numerous lifting mechanism but, preferably includes a jack such as a 500 lb. capacity jack sold under the trade name Bulldog Square Tube Trailer Jack.

An advantageous benefit of this embodiment of the portable perimeter defense system 10 is that the individual modular barriers may be quickly and easily repositioned which is beneficial as part of a strategic deterrent plan. The modular barriers may be rearranged so as to provide a level of surprise to approaching persons or vehicles.

The method of installing the portable perimeter defense system according to the present invention includes the general steps of transporting the portable perimeter defense system 20 comprising a single barrier or a plurality of barriers to the general vicinity by a trailer, removing the portable defense system 20 from a trailer, and relocating the individual modular barrier 10 or bathers 10 to the desired position by forward moving forces. These forward moving forces include moving the modular barriers or barrier utilizing wheels 62 so as to traverse the ground to the desired location. This is achieved utilizing a hauler assembly 72 or tow handle assembly 71, alone or in combination if so preferred.

More specifically, the method of installing the portable perimeter defense system 20 includes the steps of positioning an individual barrier 10 or more than one barrier 10. Individual barriers 10 are positioned by engaging the wheels 62 in the engaged position. This is achieved by using a crow bar (not shown) which is positioned beneath the curved aft edge 12 of the base plate 2. An indentation (not shown) along the aft edge may be provided to position the crow bar. The crow bar lifts the aft edge 4 off the ground so that the wheels 62 may be fully engaged to cooperate with the ground surface 9. Pins are then positioned within respective pinholes 64 to secure the wheels 62 in the engaged position. To disengage the wheels, the pins are removed, and the wheel attachments 60 are pivoted to the disengaged position shown in phantom in FIG. 11. The pins are then inserted into the uppermost pin holes 64 to secure the wheels 62 in a disengaged position.

When the hauler assembly 72 is utilized, the nose 98 engages with the correspondingly configured hauler interface 80 and a pin is inserted into pin holes 86 and 87 to secure the engagement. Hand crank 95 is actuated so as to activate the jack housed within member 94 to raise the front end of the modular barrier 10. This shifts the weight of the barrier 10 onto the wheels 62. The hauler assembly 72 may then be transported with the handle 97 to move the hauler assembly 72 and modular barrier 10 simultaneously. Once positioned, the hauler assembly 72 is removed by removing the pin from the hauler interface 80 and disengaging the nose 90 and hauler interface 80.

When the tow bar assembly 71 is utilized, as shown in FIGS. 12-14, the tow bar 74 is engaged with the tow interface 73. A pin is inserted into pinhole 76 as shown in FIG. 13 to secure the engagement. Chain 79 is connected at one end to interface 80 through hole 78 and at its other end to the tow bar 74. The user may then lift the front edge of the modular barrier 10 with the use of handle bar 81 and transport the modular barrier as shown in FIG. 14 to transport the barrier so as to traverse the ground surface. The tow bar assembly 71 and hauler assembly 71 may be used independent of one another or, alternatively, both may be used when positioning individual barriers.

The method of installing portable perimeter defense system 20 according to the first, second, and third embodiments of the present invention includes positioning a single modular barrier 10 or a plurality of modular barriers 10. As to the second and third embodiment, this method includes forming a barrier arrangement of a plurality of barriers 10 either immediately adjacent one another or with a distance there between. As to the second embodiment, the method includes the additional step of joining adjacent barriers along the sides of the front plates 3 and base plates 2 utilizing side plates 26 and 28, respectively, and securing the bolts. The portable perimeter defense barrier and system according to the present invention thereby may be rapidly deployed and, in fact, the barrier or barriers need only be "dropped" into the desired position, and the area is simultaneously protected against munitions and impact from an intruding vehicle.

The foregoing describes some embodiments that implement the concepts of the present invention. The description is for purposes of illustration and not limitation. Modifications of the above embodiments that are within the ordinary skill of the art are fully contemplated and encompassed by the scope of the present invention, which is limited only by the appended claims.

What is claimed is:

1. A portable perimeter defense system for stopping movement of a vehicle in an impact direction, the defense system comprising:

a first modular barrier;

said modular barrier comprising an upright plate and a base plate for positioning on a ground surface wherein said base plate extends generally parallel to the ground surface and said upright plate extends generally perpendicular to said base plate;

said base plate of said modular barrier comprising a non-planar aft edge configured to frictionally engage the ground surface to prevent horizontal movement of said modular barrier upon, said non-planar aft edge extending along a portion of the width of said base plate;

said aft edge including a non-linear, ground engaging interface extending along a portion thereof configured to engage and penetrate the ground surface to impede movement of the vehicle subsequent to impact, said ground engaging interface extending along a portion of said non-planar aft edge.

2. A portable perimeter defense system according to claim 1 wherein said ground engaging interface defines a saw tooth configuration.

3. A portable perimeter defense system according to claim 1 wherein said base plate comprises a fore edge, facing the impact direction, which comprises a vehicle engaging interface defined by a non-linear configuration extending along a portion thereof.

4. A portable perimeter defense system according to claim 3 wherein said vehicle engaging interface defines a saw tooth configuration.

5. A portable perimeter defense system according to claim 4 wherein said vehicle engaging saw tooth configuration extends substantially along an entire length of said fore edge of said base plate.

6. A portable perimeter defense system according to claim 1 wherein said modular barrier further comprises a kick plate extending generally perpendicular from an aft side of said front plate, said kick plate being at least approximately four inches in length and positioned above said base plate.

7. A portable perimeter defense system according to claim 6 wherein said kick plate length is at least equal to said length of said base plate extending from the aft side of said front plate.

8. A portable perimeter defense system according to claim 7 wherein said kick plate length is at least approximately twelve inches in length extending from the aft side of said front plate.

9. A portable perimeter defense system according to claim 6 wherein said modular barrier further comprises at least one kick plate reinforcement extending along an upper surface thereof.

10. A portable perimeter defense system according to claim 6 wherein said kick plate extends outwardly and generally perpendicularly from the aft side of said front plate at an acute angle relative to the horizontal.

11. A portable perimeter defense system according to claim 6 wherein said kick plate comprises an aft edge defining a ground engaging interface extending along a portion thereof, said ground engaging interface comprising a non-linear configuration for penetrating the ground surface when said modular barrier is impacted by significant forces.

12. A portable perimeter defense system according to claim 11 wherein said ground engaging interface comprises a saw tooth configuration.

13. A portable perimeter defense system according to claim 12 wherein said saw tooth configuration extends substantially along an entire length of said aft edge of said kick plate.

14. A portable perimeter defense system according to claim 1 wherein said modular barrier further comprises a ramp extending from a location along said base plate adjacent the fore edge of said base plate, and extending upwardly toward said front plate.

15. A portable perimeter defense system according to claim 1 wherein said modular barrier further includes at least one aft reinforcement extending generally perpendicular from said base plate along the aft side of said front plate for supporting said front plate.

16. A portable perimeter defense system according to claim 1 wherein said modular barrier further includes at least one fore reinforcement for supporting the fore side of said upright plate.

17. A portable perimeter defense system according to claim 16 wherein said fore reinforcement includes an upper surface defined by a first surface adjacent said upright plate and a second surface adjacent a fore edge of said base plate, said first and second surfaces defining an obtuse angle there between.

18. A portable perimeter defense system according to claim 17 wherein said second surface of said at least one aft reinforcement extends at an acute angle relative to the horizontal and supports a ramp extending from the fore edge of said base plate, upwardly toward said front plate.

19. A portable perimeter defense system according to claim 1 further comprising means for transporting said first modular barrier.

20. A portable perimeter defense system according to claim 19 wherein said means for transporting said first modular barrier comprises a wheel assembly.

21. A portable perimeter defense system according to claim 20 wherein said wheel assembly is pivotally attached to said base plate such that said wheel assembly pivots between engaged and disengaged positions.

22. A portable perimeter defense system according to claim 1 wherein said non-planar aft edge is arcuate and said ground engaging interface extends along a bottommost portion of said arcuate aft edge.

23. A portable perimeter defense system according to claim 1 further comprising a second modular barrier and means of securing said first and second barriers adjacent one another to provide a portable perimeter defense system of customizable width.

24. A portable perimeter defense system according to claim 23 wherein said first and second modular barriers each include a side plate adjacent a side edge thereof wherein each of said side plates cooperate with one another when said first and second barrier are positioned in a side-by-side arrangement.

25. A portable perimeter defense system for stopping movement of a vehicle in an impact direction, the defense system comprising:

a first modular barrier;

said modular barrier comprising an upright and a base plate for positioning on a ground surface wherein said upright plate extends generally perpendicular to said base plate;

said modular barrier further comprising a kick plate extending generally perpendicular from an aft side of said front plate and positioned a predetermined distance above said base plate, said kick plate extending at least 4 inches in the aft direction of said front plate such that said kick plate cooperates with the ground surface upon aft tilting of said barrier under sufficient impact forces.

26. A portable perimeter defense system according to claim 25 wherein said kick plate length is at least the length of said base plate extending from the aft side of said front plate.

27. A portable perimeter defense system according to claim 26 wherein said kick plate length is greater than about double the length of said base plate extending from the aft side of said front plate.

28. A portable perimeter defense system according to claim 27 wherein said modular barrier further comprises at least one kick plate reinforcement extending along an upper surface thereof.

29. A portable perimeter defense system according to claim 25 wherein said kick plate extends outwardly and generally perpendicularly from the aft side of said front plate at an acute angle relative to the horizontal.

30. A portable perimeter defense system according to claim 25 wherein said kick plate comprises an aft edge defining a ground engaging interface extending along a portion thereof, said ground engaging surface comprising a non-linear configuration for penetrating the ground surface when said modular barrier is impacted by significant forces.

31. A portable perimeter defense system according to claim 30 wherein said ground engaging interface comprises a saw tooth configuration.

32. A portable perimeter defense system according to claim 31 wherein said saw tooth configuration extends substantially along an entire length of said aft edge of said base plate.

33. A portable perimeter defense system according to claim 25 wherein said kick plate is at least approximately twelve inches in length.

34. A portable perimeter defense system according to claim 29 wherein said angle is between 0 and 60 degrees.

35. A portable perimeter defense system according to claim 34 wherein said angle is between 10 and 30 degrees.

36. A portable perimeter defense system according to claim 25 further comprising means for transporting said first modular barrier.

37. A portable perimeter defense system according to claim 25 further comprising a second modular barrier and means for securing said first and second modular barriers adjacent one another to provide a portable perimeter defense system of customizable width.

38. A portable perimeter defense system according to claim 25 wherein said modular barrier further comprises a ramp on said base plate for directing an impacting vehicle upwardly toward said upright plate so as facilitate aft tilting of the barrier upon impact wherein said kick plate engages the ground surface.

39. A portable perimeter defense system according to claim 25 wherein said modular barrier further comprises at least one aft reinforcement for supporting the aft side of said upright plate, said kick plate being supported by said aft reinforcement.

40. A portable perimeter defense system for stopping movement of a vehicle in an impact direction, the defense system comprising:

a first modular barrier;

said modular barrier comprising an upright plate and a base plate for positioning on a ground surface wherein said upright plate extends generally perpendicular to said base plate;

said first modular barrier comprising a wheel assembly for cooperating with said base plate for transporting said barrier;

and said first modular barrier further comprises a ramp extending outwardly and downwardly from the fore side of the upright plate, facing the impact direction, and extending along a length of said base plate between said upright plate and a fore edge of said base plate.

41. A portable perimeter defense system according to claim 40 wherein said wheel assembly is pivotally attached to said base plate such that said wheel assembly pivots between engaged and disengaged positions.

42. A portable perimeter defense system according to claim 40 wherein said first modular barrier further comprises at least one fore gusset reinforcement for supporting said upright plate and said ramp.

43. A portable perimeter defense system according to claim 42 wherein said at least one fore gusset reinforcement includes an upper surface defined by a first surface with a first predetermined slope adjacent said upright plate and a second surface extending outwardly facing the impact direction from said first surface and having a second predetermined slope wherein said first and second surface define an obtuse angle there between.

44. A portable perimeter defense system according to claim 43 wherein said second surface forms an angle between 5 and 25 degrees with the horizontal.

45. A portable perimeter defense system according to claim 43 wherein said first modular barrier includes a plurality of said fore gusset reinforcements.

46. A portable perimeter defense system according to claim 40 wherein said base plate fore edge includes a vehicle engaging interface.

47. A portable perimeter defense system according to claim 46 wherein said vehicle engaging interface extends substantially along the width of said base plate and includes a nonlinear configuration.

48. A portable perimeter defense system according to claim 40 further comprising a kick plate extending outwardly from an aft side of said upright plate such that upon impact, said modular barrier pivots about an aft edge thereof and said vehicle engaging interface engages an impacting vehicle and said kick plate engages a ground surface.

49. A portable perimeter defense system for stopping movement of a vehicle in an impact direction, the defense system comprising:

a first modular barrier;

said modular barrier comprising an upright plate and a base plate for positioning on a ground surface wherein said upright plate extends generally perpendicular to said base plate and a wheel assembly pivotally attached to said base plate such that said wheel assembly pivots between engaged and disengaged positions;

said base plate having an aft and fore edge wherein said fore edge, facing the impact direction, comprises a vehicle engaging interface in the form of a nonlinear configuration extending along a portion of said base plate fore edge wherein, under sufficient impact forces, said modular barrier pivots about said aft edge and said fore edge engages an impacting vehicle.

50. A portable perimeter defense system according to claim 49 wherein said non-linear configuration of said vehicle engaging interface is a saw tooth configuration.

51. A portable perimeter defense system according to claim 50 wherein said saw tooth configuration extends substantially along the entire length of said base plate fore edge.

52. A portable perimeter defense system for stopping movement of a vehicle in an impact direction, the defense system comprising:

a first modular barrier;

said modular barrier comprising an upright plate and a base plate extending generally parallel to the ground surface wherein said upright plate extends generally perpendicular to said base plate and said base plate includes a ground engaging, non-planar aft edge;

said base plate having an aft and fore edge wherein said fore edge, facing the impact direction, comprises a vehicle engaging interface in the form of a nonlinear configuration extending along a portion of said base plate fore edge wherein, under sufficient impact forces, said modular barrier pivots about said aft edge and said fore edge engages an impacting vehicle.

53. A portable perimeter defense system according to claim 52 wherein said non-linear configuration of said vehicle engaging interface is a saw tooth configuration.

54. A portable perimeter defense system according to claim 53 wherein said saw tooth configuration extends substantially along the entire length of said base plate fore edge.

55. A portable perimeter defense system for stopping movement of a vehicle in an impact direction, the defense system comprising:

a first modular barrier;

said modular barrier comprising an upright plate and a base plate for positioning on a ground surface wherein said upright plate extends generally perpendicular to said base plate;

said modular barrier further comprising at least one fore reinforcement for supporting a fore side of said face plate wherein said at least one fore reinforcement extends at an acute angle relative to the horizontal and supports a ramp extending from the fore edge of said base plate, upwardly toward said front plate wherein said fore edge of said base plate defines a vehicle engaging configuration having an irregular configuration for engaging the vehicle upon impact.

* * * * *